US006799995B2

(12) United States Patent
Hsu et al.

(10) Patent No.: US 6,799,995 B2
(45) Date of Patent: Oct. 5, 2004

(54) TWO-LAYER CONNECTOR ASSEMBLY

(75) Inventors: Han-Cheng Hsu, Taoyuan Hsien (TW); Chih-Tse Chen, Taoyuan Hsien (TW); Ching-Man Kao, Taoyuan Hsien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 10/655,137

(22) Filed: Sep. 4, 2003

(65) Prior Publication Data

US 2004/0171297 A1 Sep. 2, 2004

(30) Foreign Application Priority Data

Feb. 27, 2003 (TW) ..... 92203108 U

(51) Int. Cl.[7] ..... H01R 13/66
(52) U.S. Cl. ..... 439/541.5; 439/676
(58) Field of Search ..... 439/541.5, 676, 439/607, 79, 80

(56) References Cited

U.S. PATENT DOCUMENTS 5,759,067 A * 6/1998 Scheer ..... 439/607
6,600,865 B2 * 7/2003 Hwang ..... 385/134
6,659,807 B1 * 12/2003 Zheng et al. ..... 439/676

* cited by examiner

*Primary Examiner*—Phuong Dinh

(57) ABSTRACT

Double-layer connector assembly has an upper-layer shielding housing, a lower-layer shielding housing, and a number of two-layer modules. Each two-layer module has an upper unit, a lower unit, and a supporting body. The upper unit has upper output pins and an upper guiding plate, and the lower unit has lower output pins and a lower guiding plate. The upper guiding plate and the lower guiding plate are connected by the supporting body and form a slit. Supporting plates of the upper-layer shielding housing and the lower-layer shielding housing are installed into the slit so that the upper-layer shielding housing, the lower-layer shielding housing are installed, and two-layer modules are connected together. Besides, processing circuits are selectively connected to the output pins of the upper and lower units so that the design is more compact.

17 Claims, 7 Drawing Sheets

TWO-LAYER CONNECTOR ASSEMBLY

BACKGROUND OF THE INVENTION

1. Field of Invention

The present invention relates to a two-layer connector assembly. More particularly, the present invention relates to a two-layer connector assembly of modules.

2. Description of Related Art

Connector sockets are used for combining various electronic devices, e.g. general-purpose computers, routers, hubs, switches, together to perform complicated tasks. The number of connector sockets increases because people are trying to put more functions in various electronic devices. At the same time, the electronic devices are getting smaller and smaller, which means it is more difficult to put more connector sockets in a smaller place.

Referring to FIG. 1(*a*), which illustrates a two-layer connector socket structure according to the prior art. Two printed circuit boards installed with socket arrays are overlapped for providing enough number of sockets. Referring to FIG. 1(*b*), which illustrates another two-layer connector socket structure according to the prior art. In this socket structure, the sockets are assembled as a complete module and then the module is installed onto the printed circuit board.

The socket structure as illustrated in FIG. 1(*a*) increases the production cost and causes heat problem. In contrast, the socket structure as illustrated in FIG. 1(*b*) is more compact. However, it is difficult to assemble the socket structure in FIG. 1(*b*) and the whole structure needs to be disassembled if any socket is out of order.

For the forgoing reasons, there is a need for designing a more flexible and compact socket structure.

SUMMARY OF THE INVENTION

The present invention is directed to a two-layer connector assembly that satisfies this need of a compact and flexible design of sockets.

According to a preferred embodiment of the present invention, a two-layer connector includes a number of two-layer modules, an upper-layer shielding housing, and a lower-layer shielding housing.

Each two-layer module has an upper-layer unit, a lower layer unit and a supporting body. The upper-layer unit has upper output pins and an upper guiding plate. The lower-layer unit has lower output pins and a lower guiding plate. The upper guiding plate and the lower guiding plate are connected by the supporting body directly or indirectly so that the upper guiding plate and the lower guiding plate are arranged in substantially parallel. In addition, the upper guiding plate and the lower guiding plate form a slit.

The upper-layer shielding housing and the lower-layer shielding housing have a number of through-holes of two mirrored rows. In addition, the upper-layer shielding housing has a first supporting slice and the lower-layer shielding has a second supporting slice.

The first supporting slice of the upper-layer shielding housing and the second slice of the lower-layer shielding housing are placed into the aforementioned slit as a stack so that the upper-layer shielding housing, the lower-layer shielding housing, and the two-layer modules are connected together.

In addition, a processing circuit is selectively inserted between the upper output pins and the lower output pins for processing the signals transmitted between the upper output pins and the lower output pins. Examples of the processing circuit include transformers, Light Emitted Diode(LED), modulating/demodulating circuits, etc. Therefore, some circuits originally located on the printed circuit board are now embedded in the two-layer connector assembly and the space of the printed circuit is spared for a more compact design of electronic devices.

Hence, there are at least following advantages of the present invention. First, it is easier to assemble the two-layer connector assembly according to the present invention. Second, elements are easily to be substituted if any element is out of order because the connector assembly is composed of modules. In addition, it is easy to embed signal processing circuits in the connector assembly according to the present invention so that the space of the printed circuit board is used for more circuit or a more compact design of electronic device is possible.

It is to be understood that both the foregoing general description and the following detailed description are by examples, and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

FIG. 1(*b*) illustrates another design of two-layer socket structure according to the prior art;

FIG. 2(*b*) illustrates another aspect of FIG. 2(*a*);

FIG. 7(*b*) illustrates a sectional view of another preferred embodiment according to the present invention.

DESCRIPTION OF THE PREFERRED EMBODIMENTS

Figure 1A:
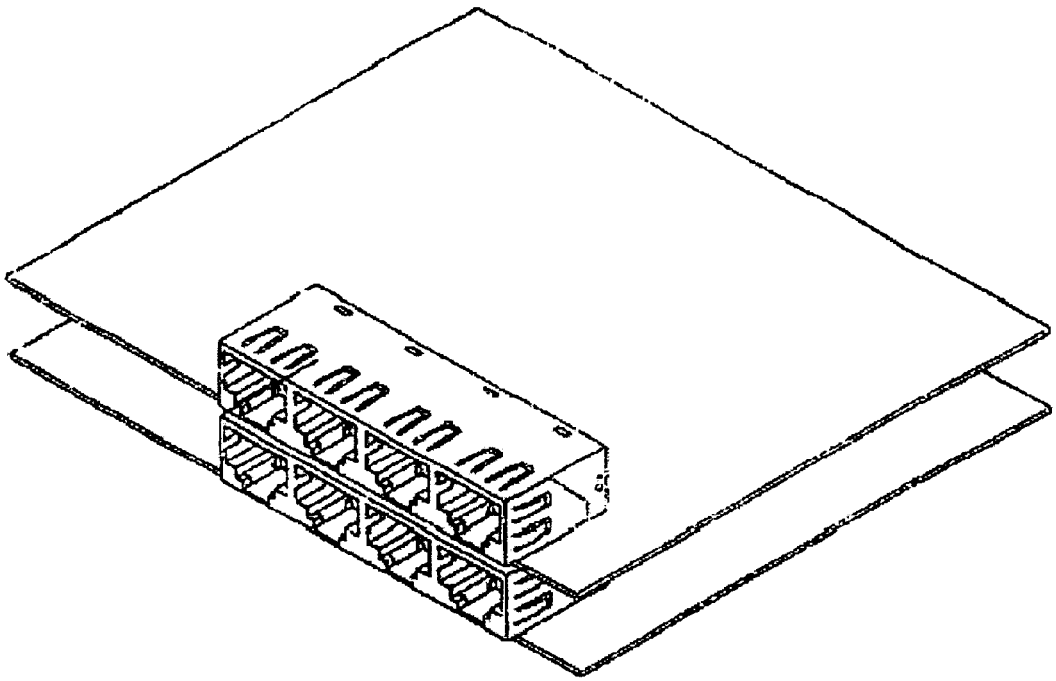
Fig.1(a)(Prior Art)
FIG. 1(*a*) illustrates a design of two-layer printed circuit boards according to the prior art.
Figure 1B:
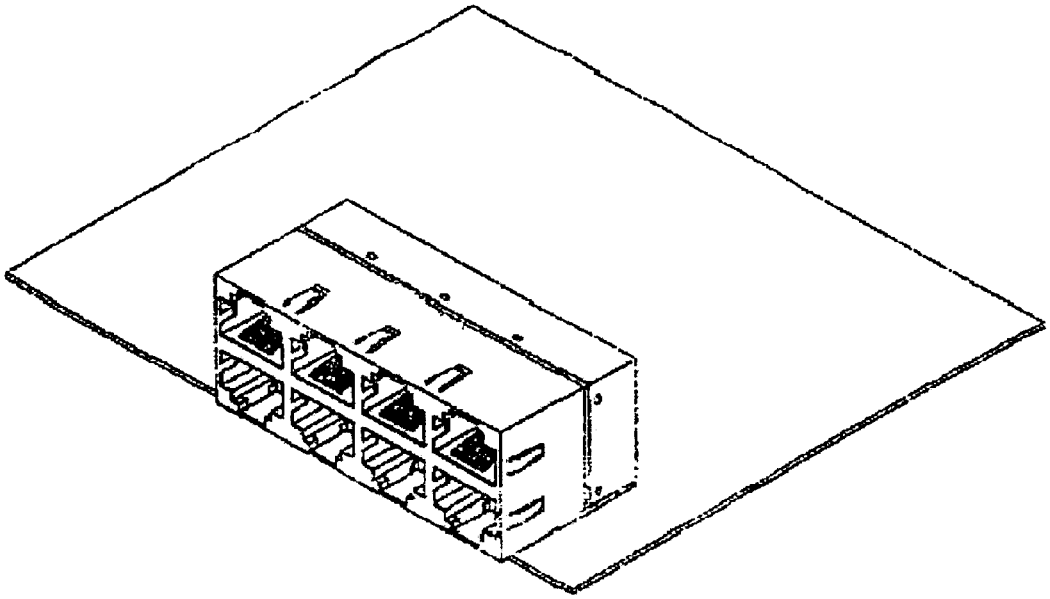
Fig. 1(b) (Prior Art)

Reference will now be made in detail to the present preferred embodiments of the invention, examples of which are illustrated in the accompanying drawings. Wherever possible, the same reference numbers are used in the drawings and the description to refer to the same or like parts.

Preferred Embodiment

Figure 2A:
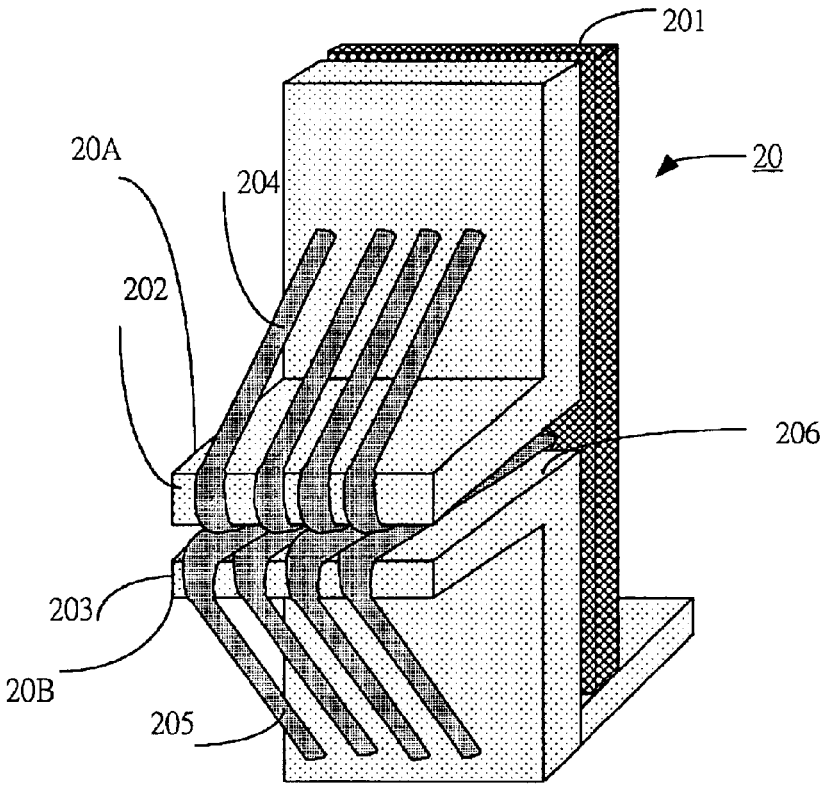
FIG. 2(*a*) illustrates a portion of elements of one preferred embodiment according to the present invention.
Figure 2B:
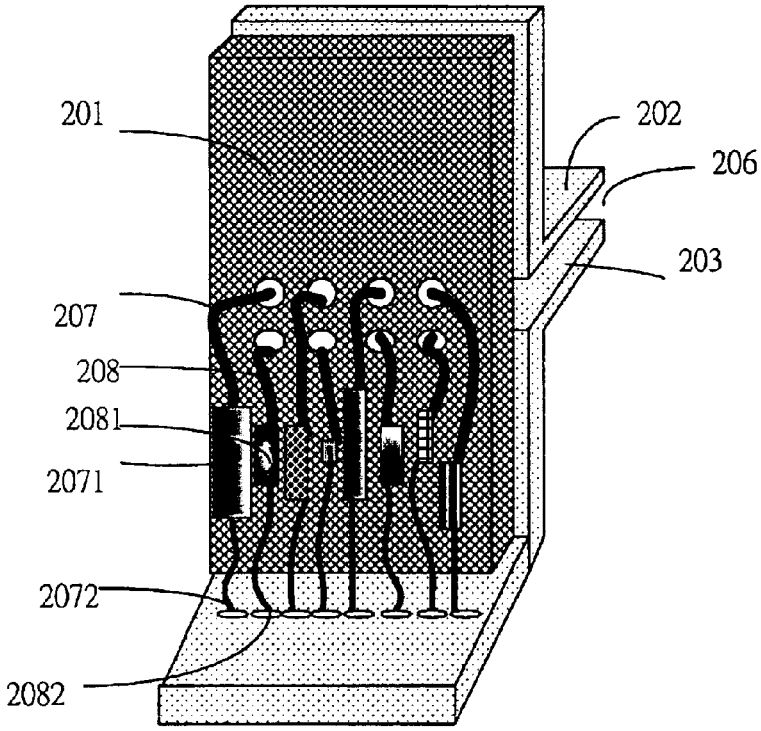

Referring to FIG. 2(*a*) and FIG. 2(*b*), which illustrate a two-layer module according to present invention.

As shown in FIG. 2(*a*), the two-layer module 20 has an upper-layer unit 20A, a lower-layer unit 20B and a supporting body 201. The upper-layer unit 20A has a number of upper output pins 204 and an upper guiding plate 202. Similarly, the lower-layer unit 20B has a number of lower output pins 205 and a lower guiding plate 203.

The supporting body 201 is used to connect the upper guiding plate 202 and the lower guiding plate 203 and a slit 206 is formed between the upper guiding plate 202 and the lower guiding plate 203. The upper output pin installed in the upper guiding plate 202 and said lower output pin installed in the lower guiding plate 202 are extended from the slit 206 and symmetrical to each other.

Reference is taken to FIG. 2(*b*), which illustrates another side of elements in FIG. 2(*a*). The upper output pins 204 are electrically connected to upper input pins 2072 via upper intermediate devices 207. Similarly, the lower output pins 205 are electrically connected to the lower input pins 2082 via lower intermediate devices 208. According to different needs for signal processing, upper processing circuits 2071 and lower processing circuits are selectively added in the upper intermediate devices 207 and the lower intermediate devices 208. Examples of the upper processing circuits and the lower processing circuits include transformers, LEDs, various modulating/demodulating circuits for encoding/decoding signals.

Besides, as an example, a circuit board is used as the supporting body. Further, in such example, the upper processing circuits 2071 and the lower processing circuits are installed on the circuit board.

Figure 3:
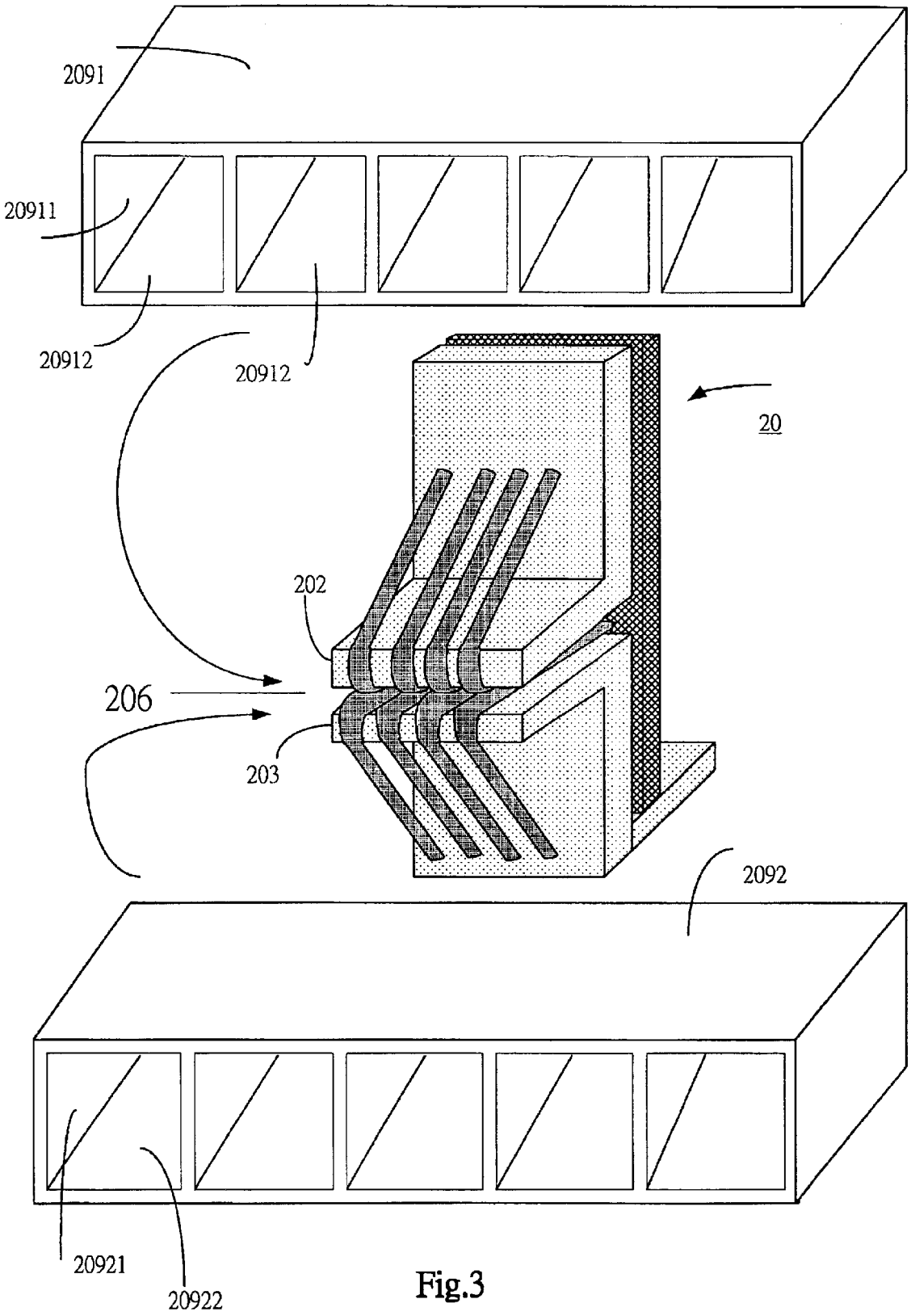
FIG. 3 illustrates a method for assembling elements of the preferred embodiment according to the present invention.

Next, referring to FIG. 3, a method is described for assembling the two-layer modules as shown in FIG. 2(*a*) and FIG. 2(*b*) to form a two-layer connector assembly.

The upper-layer shielding housing 2091 and the lower-layer shielding housing 2092 have a number of upper-layer through-holes 20911 and lower-layer through-holes 20921, respectively. In addition, the upper-layer shielding housing 2091 and the lower-layer shielding housing 2092 have a first supporting slice 20912 and a second supporting slice 20922, respectively.

The first supporting slice 20912 of the upper-layer shielding housing 2091 and the second supporting slice 20922 of the lower-layer shielding housing are inserted into the slit 206 defined by the upper guiding plate 202 and the lower guiding plate 203. In other words, the upper guiding plate 202 and the lower guiding plate 203 together clip the first supporting slice 20912 and the second supporting slice 20922 if the thickness of the stack of the first supporting slice 20912 and the second supporting slice 20922 is essentially identical to the width of the slit 206. Besides, additional fastening devices, like latch or spring slice, are used for robustly fastening the upper-layer shielding housing 2091 and the lower-layer shielding housing 2092 in the slit 206.

Figure 4:
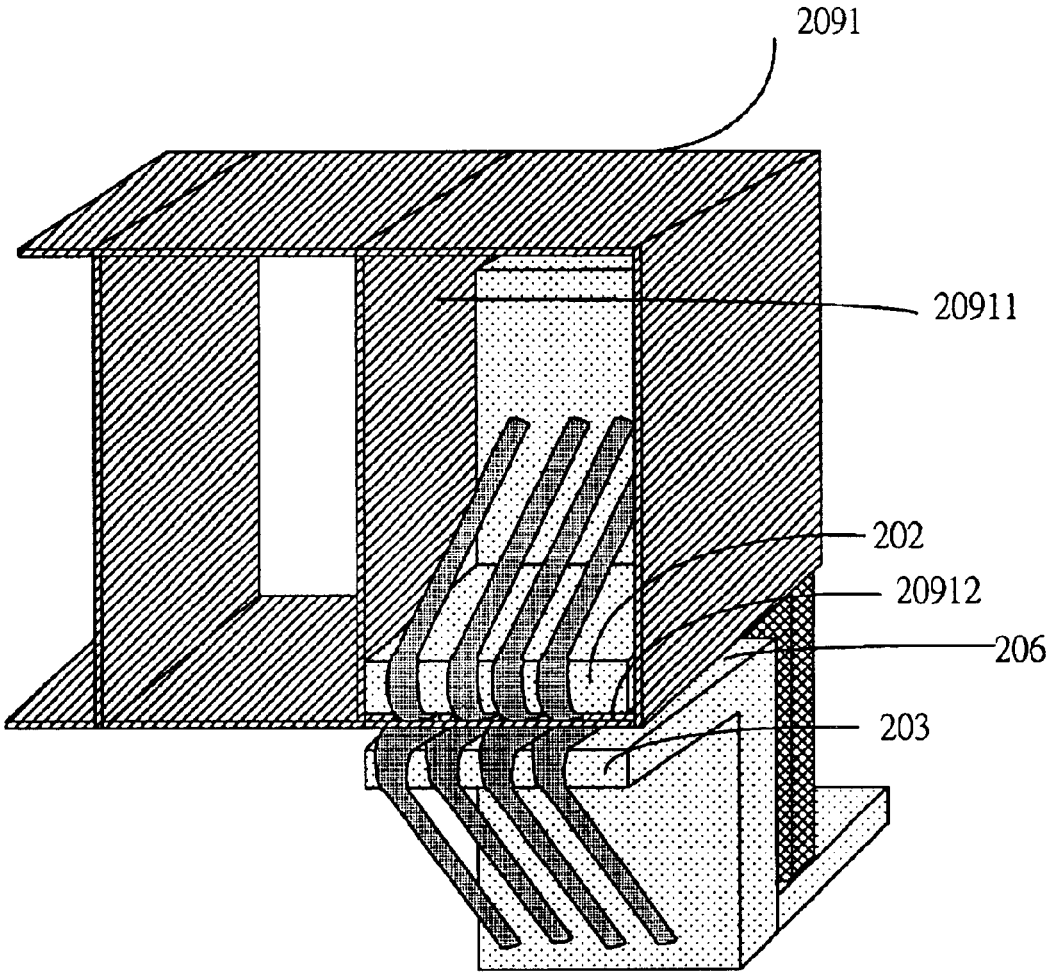
FIG. 4 illustrates another aspect for assembling elements of the preferred embodiment according to the present invention.

Reference is taken to FIG. 4, which more clearly illustrates the method for installing the upper-layer shielding housing 2091 to the two-layer module 20. It is noted that installing or uninstalling the two-layer modules 20 from the upper-layer shielding housing 2091 is a simple task.

After installing the upper-layer shielding housing 2091, it is similar to install the lower-layer shielding housing 2092. Next, other two-layer modules 20 are able to be installed to the other through-holes 29011, 20921 of the upper-layer shielding housing 2091 and the lower-layer shielding housing 2092 and then a two-layer connector assembly is formed.

Figure 5:
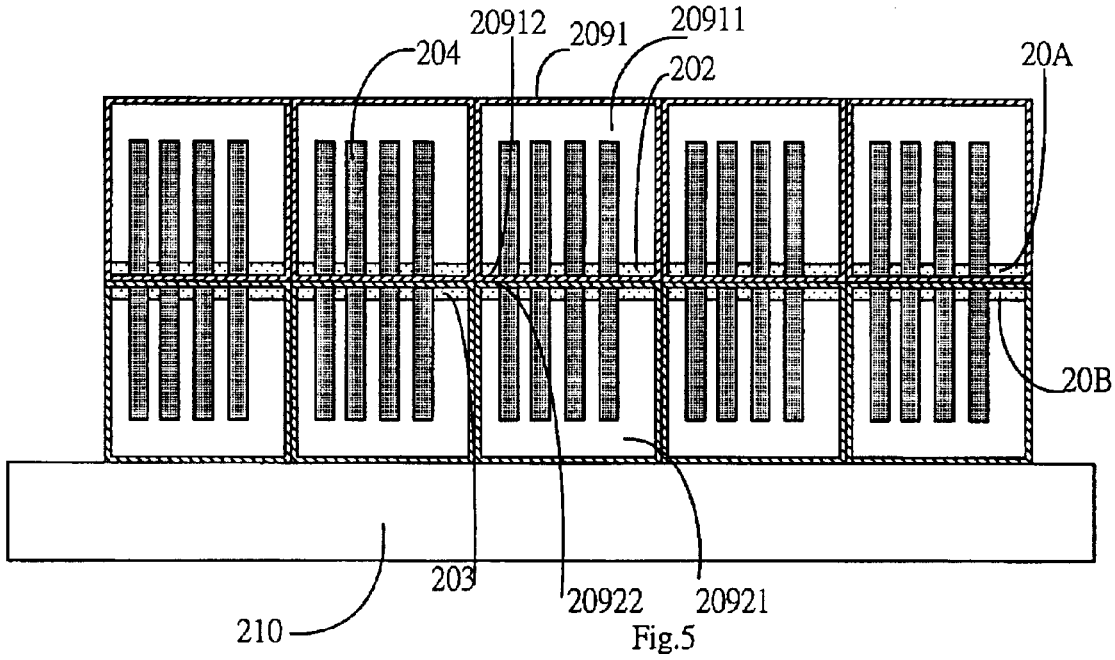
FIG. 5 illustrates a plan view of the preferred embodiment according the present invention.

Reference is taken to FIG. 5, which illustrates a two-layer connector assembly having ten sockets in two rows. Such two-layer connector assembly is then installed to a printed circuit board so that external electronic devices are able to deliver signals to the circuits 211 on the printed circuit board.

Examples of such connectors are sockets, e.g. RJ-45 sockets. However, it is to be noted that the present invention does not limit to sockets. Besides, the upper-layer unit 20A and the lower-layer unit 20B in aforementioned two-layer module 20 can be same connectors, e.g. RJ-45 sockets or different connectors. Similarly, sockets in same layer do not need to be same kind of sockets.

Figure 6:
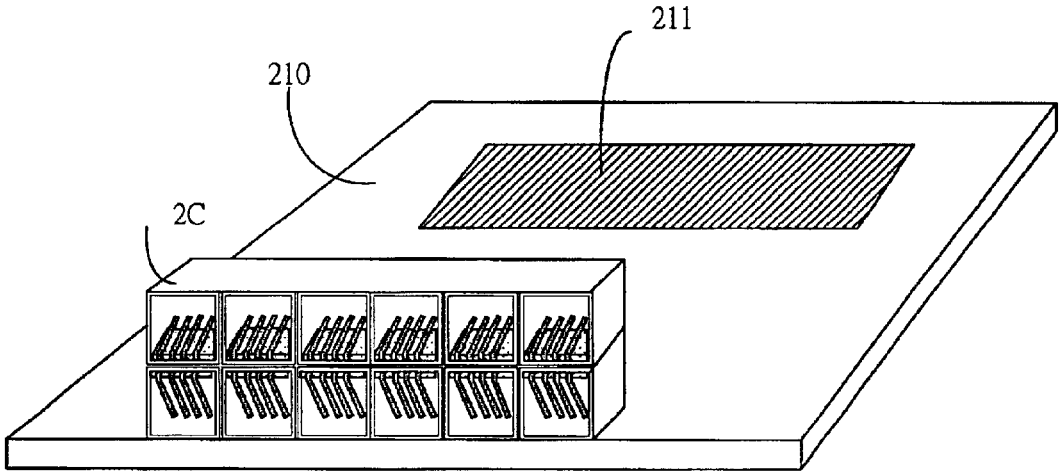
FIG. 6 illustrates a perspective view of the preferred embodiment according to the present invention.

FIG. 6 provides a perspective view of FIG. 5 illustrating a printed circuit board 210 having a two-layer connector assembly 2C. A set of circuit 211, e.g. switching circuits, hub circuits, general purpose or specific purpose circuits, are installed on the printed circuit board 210. External devices (not shown) can exchange data with the circuits 211 via the two-layer connector assembly.

Besides, it is to be noted that the connection relation among the supporting body 201, the upper guiding plate 202, and the lower guiding plate 203 can be adjusted according the needs of designers. For example, reference is taken to FIG. 7(*a*) and FIG. 7(*b*), which illustrate two variations of different designs.

Figure 7A:
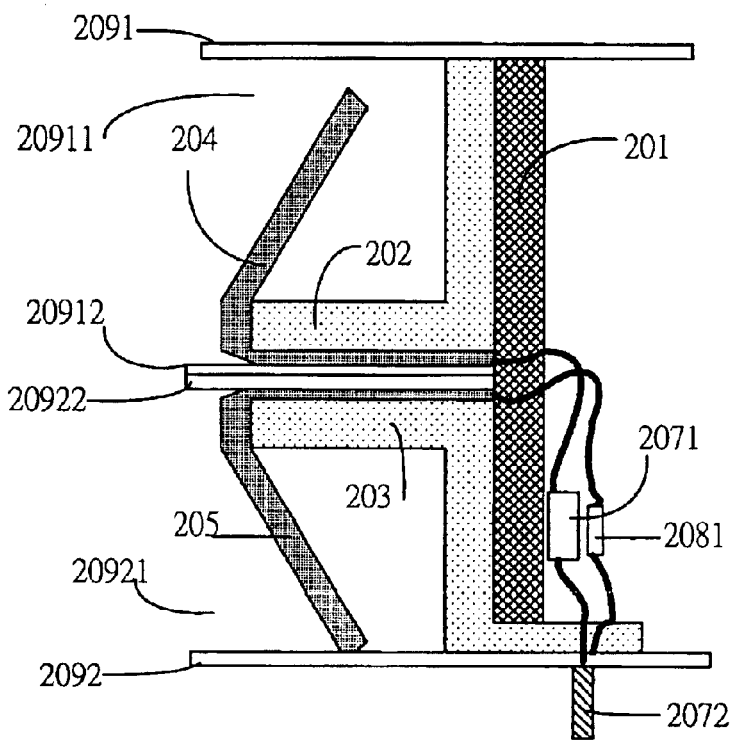
FIG. 7(*a*) illustrates a sectional view of the preferred embodiment according to the present invention.
Figure 7B:
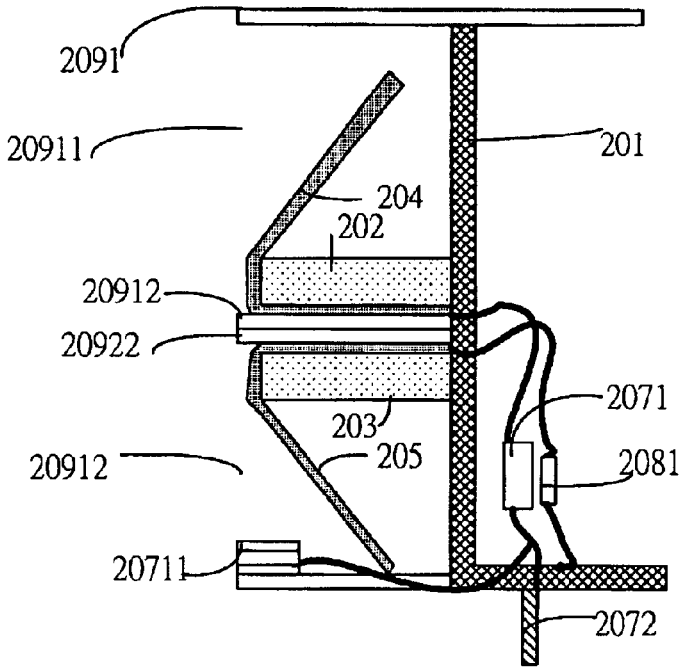

In FIG. 7(*a*), the upper guiding plate 202 and the lower guiding plate 203 are extended as a "L" structure, and another independent supporting body 201 is used for connecting these two "L" shape structures. In contrast, in FIG. 7(*b*), the upper guiding plate 202 and the lower guiding plate 203 are directly installed on the supporting plate 201.

Therefore, persons skilled in the art should know that the present invention at least include the case of shaping the upper guiding plate 202 and the lower guiding plate 203 as a whole body and through-holes are defined corresponding to the slit. Besides, FIG. 7(*b*) illustrates a method for connecting the signals to LED 20711 so that the status of the signals can be shown.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A two-layer connector assembly comprising:

a plurality of two-layer modules, each two-layer module comprising:

an upper-layer unit having a plurality of upper output pins and an upper guiding plate wherein said upper output pins are installed on said upper guiding plate;

a lower-layer unit having a plurality of lower output pins and a lower guiding plate wherein said lower output pins are installed on said lower guiding plate; and a supporting body for connecting said upper-layer unit and said lower-layer unit such that said upper guiding plate and said lower guiding plate aligning in substantially parallel arrangement and a slit being defined between said upper guiding plate and said lower guiding plate;

an upper-layer shielding housing wherein said upper-layer shielding comprises a first supporting slice and defines a plurality of upper-layer through holes, and each said upper-layer through hole contains one said upper-layer unit of one said two-layer module; and an lower-layer shielding housing wherein said lower-layer shielding housing comprises a second supporting slice and defines a plurality of lower-layer through holes, and each said lower-layer through hole contains one said lower-layer unit of one said two-layer module;

wherein said upper-layer through holes and said lower-layer through holes are arranged as two mirrored rows, and said first supporting slice and said second supporting slice are placed in said slit in the manner of a stack such that said upper shielding housing, said lower shielding housing and said plurality of two-layer modules are connected together.

2. The connector assembly of claim 1, wherein said upper-layer unit of each said two-layer module further comprises:

a plurality of upper intermediate devices; and a plurality of upper input pins corresponding to said upper output pins, wherein said upper intermediate device connects said upper output pins and said upper input pins, said upper intermediate device selectively comprises an upper processing circuit for processing signals transmitted between corresponding said upper input pins and said upper output pins; and wherein said lower-layer unit of each said two-layer module further comprises:

a plurality of lower intermediate devices; and a plurality of lower input pins corresponding to said lower output pins, said lower intermediate device selectively comprises a lower processing circuit for processing signals transmitted between corresponding said lower input pin and said lower output pin.

3. The connector assembly of claim 2, wherein said upper input pins and lower input pins are connected to a printed circuit board.

4. The connector assembly of claim 3, wherein said supporting body is a circuit board.

5. The connector assembly of claim 4, wherein said upper processing circuits and lower processing circuits are installed on said circuit board.

6. The connector assembly of claim 4, wherein said upper processing circuits and said lower processing circuits comprise LEDs.

7. The connector assembly of claim 1, wherein said upper-layer units and said lower-layer units are sockets.

8. The connector assembly of claim 7, wherein said sockets are RJ-45 sockets.

9. The connector assembly of claim 1 further comprising a fastening means for fixing the connection among said first supporting slice, said second supporting slice, said upper guiding plate, and said lower guiding plate.

10. A two-layer module connected with a printed circuit board comprising:

a supporting body;

an upper-layer unit comprising a plurality of upper connecting devices and an upper guiding plate, wherein each said upper connecting device comprises an upper output pin, an upper intermediate device and an upper input pin, and wherein said upper input pin is electrically connected to said printed circuit board, said upper output pin is installed on said upper guiding plate, said upper guiding plate is connected to said supporting body, said upper intermediate device is electrically connected to said upper output pin and said upper input pin, and said upper intermediate device selectively comprises a upper processing circuit for processing signals transmitted between said upper input pin and said upper output pin; and a lower-layer unit comprising a plurality of lower connecting devices and a lower guiding plate, wherein each said lower connecting device comprises a lower output pin, a lower intermediate device, and a lower input pin, and wherein said lower input pin is electrically connected to said printed circuit board, said lower output pin is installed on said lower guiding plate, said intermediate device is electrically connected to said lower output pin and said lower input pin, said lower intermediate device selectively comprises a lower processing circuit for processing signals transmitted between said lower input pin and said lower output pin, wherein said upper guiding plate and said lower guiding plate are connected to said supporting body and a slit being defined between said upper guiding plate and said lower guiding plate, and said -upper output pin and said lower output pin are extended from said slit and symmetrical to each other.

11. The two-layer module of claim 10, wherein said slit is used for placing a first supporting slice of an upper shielding housing and a second supporting slice of a lower shielding housing such that said upper shielding housing contains said upper-layer unit and said lower shielding housing contains said lower-layer unit.

12. The two-layer module of claim 10, wherein said supporting body is a circuit board.

13. The two-layer module of claim 10, wherein said upper processing circuit and said lower processing circuit are installed on said circuit board.

14. The two-layer module of claim 10, wherein said upper processing circuits and said lower processing circuits comprise LEDs.

15. The two-layer module of claim 10, wherein said upper-layer unit and said lower-layer unit are sockets.

16. The two-layer module of claim 15, wherein said sockets are RJ-45 sockets.

17. A two-layer module connected with a printed circuit board comprising:

a supporting body;

an upper-layer unit comprising a plurality of upper connecting devices and an upper guiding plate, wherein each said upper connecting device comprises an upper output pin, an upper intermediate device and an upper input pin, and wherein said upper input pin is electrically connected to said printed circuit board, said upper output pin is installed on said upper guiding plate, said upper guiding plate is connected to said supporting body, said upper intermediate device is electrically connected to said upper output pin and said upper input pin, and said upper intermediate device selectively comprises a upper processing circuit for processing signals transmitted between said upper input pin and said upper output pin; and a lower-layer unit comprising a plurality of lower connecting devices and a lower guiding plate, wherein each said lower connecting device comprises a lower output pin, a lower intermediate device, and a lower input pin, and wherein said lower input pin is electrically connected to said printed circuit board, said lower output pin is installed on said lower guiding plate, said intermediate device is electrically connected to said lower output pin and said lower input pin, said lower intermediate device selectively comprises a lower processing circuit for processing signals transmitted between said lower input pin and said lower output pin, wherein said upper guiding plate and said lower guiding plate are connected to said supporting body and a slit being defined between said upper guiding plate and said lower guiding plate for placing a first supporting slice of an upper shielding housing and a second supporting slice of a lower shielding housing such that said upper shielding housing contains said upper-layer unit and said lower shielding housing contains said lower-layer unit, and said upper guiding plate and said lower guiding plate being symmetrical about said slit.

* * * * *